US005218945A

United States Patent [19]

Kapellen et al.

[11] Patent Number: 5,218,945

[45] Date of Patent: Jun. 15, 1993

[54] PRO-ACTIVE CONTROL SYSTEM FOR A HEAT ENGINE

[75] Inventors: Daniel R. Kapellen, Lisle; Nick Dicosola, North Aurora, both of Ill.

[73] Assignee: Gas Research Institute, Chicago, Ill.

[21] Appl. No.: 898,006

[22] Filed: Jun. 16, 1992

[51] Int. Cl.[5] ..... F02D 41/14; F02D 31/00; F02D 43/00

[52] U.S. Cl. ..... 123/687; 123/699; 123/352; 123/418

[58] Field of Search ..... 123/339, 350, 352, 416, 123/418, 428, 478, 687, 699, 700

[56] References Cited

U.S. PATENT DOCUMENTS

| | | | |
|---|---|---|---|
| 4,203,394 | 5/1980 | Aono et al. | 123/687 X |
| 4,210,114 | 7/1980 | Watanabe | 123/687 |
| 4,619,232 | 10/1986 | Morris | 123/352 X |
| 4,667,632 | 5/1987 | Shimomura et al. | 123/352 X |
| 4,879,983 | 11/1989 | Shimomura et al. | 123/352 X |
| 4,899,280 | 2/1990 | Onari et al. | 123/339 X |
| 4,947,813 | 8/1990 | Vainshtein et al. | 123/352 |
| 4,955,344 | 9/1990 | Tatsumi et al. | 123/352 |
| 5,070,837 | 12/1991 | Nishimura et al. | 123/339 |
| 5,094,207 | 3/1992 | Krampe et al. | 123/339 |

*Primary Examiner*—Willis R. Wolfe

*Attorney, Agent, or Firm*—Gifford, Groh, Sprinkle, Patmore and Anderson

[57] ABSTRACT

A pro-active engine control system for a rotary engine having a governor generating a fuel command signal determined to maintain the actual engine speed at a setpoint speed. A fuel logic circuit converts the fuel command signal to a flow rate signal actuating a fuel delivery device to supply fuel to the engine at a rate required to maintain the speed of the engine at the setpoint speed. The fuel command signal is multiplied by a desired air-fuel ratio to generate an air command signal. An air logic circuit converts the air command signal to air rate signals activating an air delivery device to deliver air to the engine at a rate such that the ratio of air-to-fuel delivered to the engine has the desired air-fuel ratio. The pro-active engine control system also includes a spark advance signal generator for generating a spark advance signal in response to actual engine speed and fuel command signals and an ignition signal generator activating the engine's spark plug at a time determined to optimize the torque of the engine in response to a rotary position signal and the spark advance signal. In the preferred embodiment, the engine is a rotary engine and the fuel is natural gas.

33 Claims, 2 Drawing Sheets

PRO-ACTIVE CONTROL SYSTEM FOR A HEAT ENGINE

BACKGROUND OF THE INVENTION

I. Field of the Invention

The invention is related to control systems for heat engines and, in particular, to a pro-active control system in which fuel flow rate and air flow rate are changed simultaneously.

II. Description of the Prior Art

Various methods for controlling the operation of internal combustion or heat engines are known in the art. Today, in most of the fuel control systems for internal combustion engines, the quantity of fuel or fuel flow rate being supplied to the engines is determined from the quantity of air being supplied. Some of the control systems use air flow sensors which directly measure the quantity of air being supplied to the engine such as the engine control systems taught by Oyama et al in U.S. Pat. No. 4,205,377 and 4,825,838, Koji et al in U.S. Pat. No. 4,517,946, and van Bruck in U.S. Pat. No. 4,677,559. These fuel control systems also use an oxygen sensor to maintain a predetermined partial pressure of oxygen in the engine's exhaust; preferably, on the lean side of stoicheometric.

In other engine control systems, the air flow to the engine is computed as a function of engine speed and the pressure of the air in the engine's intake manifold or the position of the throttle plate in the intake manifold.

Other engine control systems known in the art use alternate engine parameters for closing the loop from the engine back to the electronic controller. L. Taplin in U.S. Pat. No. 3,789,816 teaches a lean burn fuel control system in which the air flow rate is held constant and the fuel flow rate is decremented until the engine vibrates at a predetermined amplitude referred to as engine roughness. The fuel flow rate is then dithered to maintain a predetermined engine roughness. The engine roughness in the engine control system taught by Taplin is measured by a vibration sensor attached to the engine.

C.K. Leung, in U.S. Pat. No. 4,344,140, teaches an improvement to Taplin's engine control system in which engine roughness is determined by measuring the instantaneous rotational velocity of the engine's flywheel. In the fuel control system taught by C.K. Leung, the roughness signal is used to bias the fuel rate being supplied to the engine to maintain the engine roughness at a predetermined level.

In a similar manner, Latsch in U.S. Pat. No. 1,616,162, Binachi et al in U.S. Pat. No. 4,172,433, and Frobenuis in U.S. Pat. No. 4,140,083, all disclose engine control systems in which the fuel delivered to the engine is controlled or adjusted to maintain the fluctuations of the rotational speed of the engine's output at a predetermined value.

In an alterative engine control system, Latsch in U.S. Pat. No. 4,064,846, teaches an engine control system in which an engine control variable, such as fuel, air, or ignition timing, is modulated and the phase of the resultant variations in crankshaft's acceleration is used to adjust the magnitude of engine control variable.

These engine control systems collectively are reactive control systems in which the fuel flow rate is controlled in response to a change in the air flow rate to the engine, i.e., the opening of the throttle valve in the air intake manifold. In contrast, the engine control system described herein is a pro-active engine control system in which the fuel flow rate and the air-flow rate are changed, simultaneously, to maintain the ratio of air to fuel being supplied to the engine at a predetermined or desired air-fuel ratio.

SUMMARY OF THE INVENTION

A pro-active engine control system having an engine speed sensor for generating an actual speed signal, an oxygen sensor generating an $O_2$ signal indicative of the oxygen content of the engine's exhaust gases, a governor responsive to the actual speed signal for generating a fuel command signal having a value operative to maintain the actual speed of the engine at a setpoint speed, and fuel delivery means for delivering fuel to the engine at a rate required to maintain the actual engine speed equal to said setpoint speed in response to the actual engine speed. The pro-active engine control system also has an air-fuel ratio generator for generating a desired air-fuel ratio in response to the $O_2$ signal generated by the oxygen sensor, means for multiplying the desired air-fuel ratio by the fuel command signal to generate an air command signal, an air delivery means for delivering air to the engine, and air logic means for activating the air delivery means to deliver air to the engine at a rate corresponding to the air command signal, and air and fuel flow rates forming an air-fuel mixture having an air-to-fuel ratio corresponding to the desired air-fuel ratio. The pro-active engine control system also has spark advance means for generating a spark advance signal in response to the fuel command signal and the actual engine speed signal, and an ignition signal generator responsive to the spark advance signal and a signal generated by the engine speed sensor indicative of the rotational position of a rotational member of the engine to generate an ignition signal activating each spark plug in the engine to ignite the air-fuel mixture at a time determined to optimize the torque output in the engine.

In the preferred embodiment, the heat engine is a rotary engine and the fuel is a gaseous fuel such as natural gas or propane.

The object of the invention is a pro-active engine control system in which the air and fuel flow rates are changed simultaneously.

Another object of the invention is an engine control system in which a governor computes the fuel required to maintain the actual engine speed at a desired speed.

Still another object of the invention is a control system in which the air flow rate is determined from a setpoint air-fuel ratio and a fuel command signal.

Another object of the invention is a control system in which a desired air-fuel ratio is modified by an offset air-fuel ratio in response to actual oxygen content of the engine's exhaust being different from a setpoint oxygen signal to compensate for manufacturing tolerances and wear of the air and fuel delivery devices.

Yet another object of the invention is an engine control system not using an air flow measuring device or a manifold pressure sensor.

Still another object of the invention is an engine control system which does not require a direct feedback of the throttle's position.

A final object of the invention is an engine control system for a rotary engine utilizing natural gas as the fuel.

These and other objects of the invention will become more apparent from a reading of the specification in conjunction with the drawings.

DETAILED DESCRIPTION OF THE INVENTION AND PREFERRED EMBODIMENT THEREOF

Figure 1:
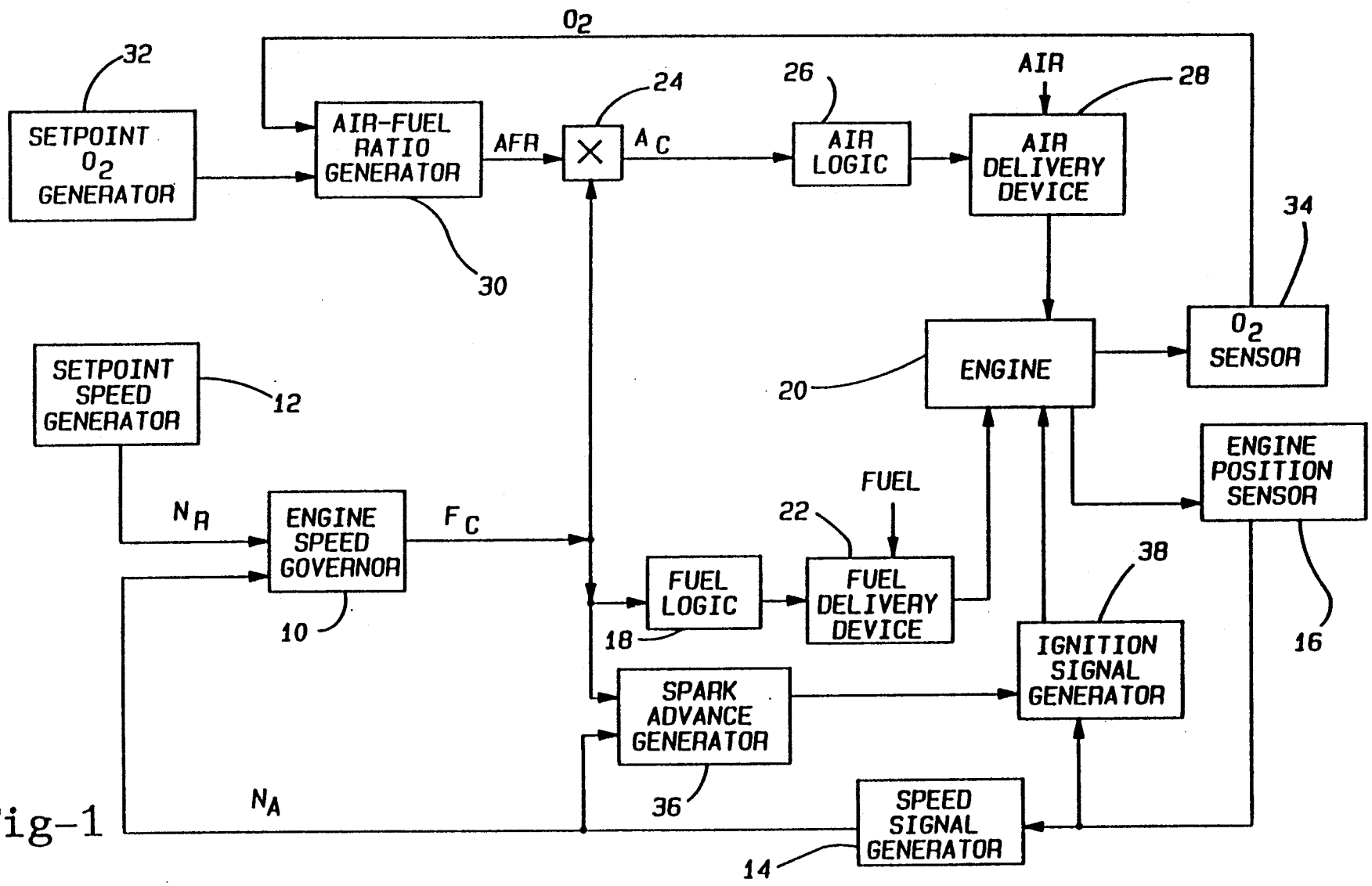
FIG. 1 is a block diagram of the pro-active engine control system.

FIG. 1 is a block diagram of the pro-active engine control system. An Engine Speed Governor 10 receives a setpoint or reference speed signal $N_R$ from a Setpoint Speed Generator 12 and an actual speed signal $N_A$ from a Speed Signal Generator 14. The Speed Signal Generator 14 receives engine position signals $P_E$ from an Engine Position Sensor 16 which detects predetermined rotational positions of an output member of an Engine 20. Various types of engine position sensors are known in the art. These engine position sensors monitor the rotational position of the engine's rotor or crankshaft and produce a pulse signal, $P_E$, each time the engine's rotor or one of its pistons reaches a predetermined position during its operational cycle such as the top dead center position. The Speed Signal Generator 14 will measure the time between successive engine position signals, $P_E$, and generate the actual engine speed signal, $N_A$, as an inverse function of the time between the successive engine position signals, $P_E$, as is known in the art. The Engine Speed Governor 10 will respond to the difference between the setpoint speed signal $N_R$ and the actual speed signal $N_A$ and generate a fuel command signal $F_C$ which will maintain the actual engine speed equal to the setpoint engine speed. The Engine Speed Governor 10 is an isochronous governor which maintains the engine speed at the setpoint speed independent of changes in the engine's load. The isochronous governor avoids engine speed oscillation by providing compensation for inherent delays in recognition of engine speed and realization of torque at low engine speeds. It uses a proportional-integral control loop that senses the difference, positive or negative, between the actual engine speed and the reference speed. The isochronous governor increases the rate at which fuel is delivered to the engine when the actual engine speed is less than the setpoint speed and decreases the rate at which fuel is being delivered to the engine when the actual engine speed is greater than the setpoint speed.

The fuel command signal $F_C$, the value of which is indicative of the rate at which fuel is to be supplied to the engine, is transmitted to a Fuel Logic Circuit 18. The Fuel Logic Circuit 18 generates fuel control signals which actuate a Fuel Delivery Device 22 to deliver fuel to the Engine 20 at the rate determined by the Engine Speed Governor 10.

The fuel commanded signal, $F_C$, is also transmitted to a multiplier circuit 24 where it is multiplied with a desired air-fuel ratio (AFR) signal to generate an air command signal, $A_C$. The air command signal, $A_C$, is received by an Air Logic Circuit 26 which converts the air command signal, $A_C$, to an air control signal which actuates an Air Delivery Device 28 to deliver air to the Engine 20 at the rate determined by the air commanded signal. In this manner, air and fuel are supplied to the engine to form an air-fuel mixture in which the ratio of air to fuel is equal to the desired air-fuel ratio.

This form of air-fuel control is a pro-active control in which the rate of air and fuel flow changes are effected simultaneously as opposed to a reactive control in which a change in air flow rate must be measured to before the fuel flow rate is changed, such as in the conventional manifold pressure-engine speed controllers used on current automotive engines. Because the fuel and air flow rates are changed simultaneously, the need for acceleration fuel enrichment is significantly reduced and, under a wide variety of conditions, acceleration enrichment is effectively eliminated.

The air-fuel ratio signal, AFR, is generated by an Air-Fuel Ratio Generator 30 in response to a setpoint $O_2$ signal generated by a Setpoint $O_2$ Signal Generator 32 and an actual $O_2$ signal generated by a fast response proportional $O_2$ Sensor 34 measuring the partial pressure of oxygen, i.e., the oxygen content in the exhaust gases emitted by the Engine 20. The Air-Fuel Ratio Generator 30 compares the actual $O_2$ signal with the setpoint $O_2$ signal and generates an air-fuel ratio signal, AFR, having a value which maintains the actual $O_2$ signal equal to the setpoint $O_2$ signal. Preferably, the setpoint $O_2$ signal is on the lean side of stoichiometric and has a value corresponding to the output of the $O_2$ Sensor 34 in response to the exhaust gas having a 4% excess oxygen content.

A Spark Advance Generator 36 is responsive to the fuel control signal $F_C$ and the actual engine speed signal $N_A$ and generates a spark advance signal in a known manner. The spark advance signal is received by an Ignition Signal Generator 38 which generates ignition signals which cause the engine's spark plugs to fire (generate a spark) at the appropriate time. The Ignition Signal Generator 36 also receives the pulse signals $P_E$ from the Engine Position Sensor 16 which synchronizes the generation of ignition signals with the operational cycles of the engine to optimize the engine's output torque. The Spark Advance Generator 36 and the Ignition Signal Generator 38 are of conventional design and their details need not be discussed further for an understanding of the pro-active engine control system.

Figure 2:
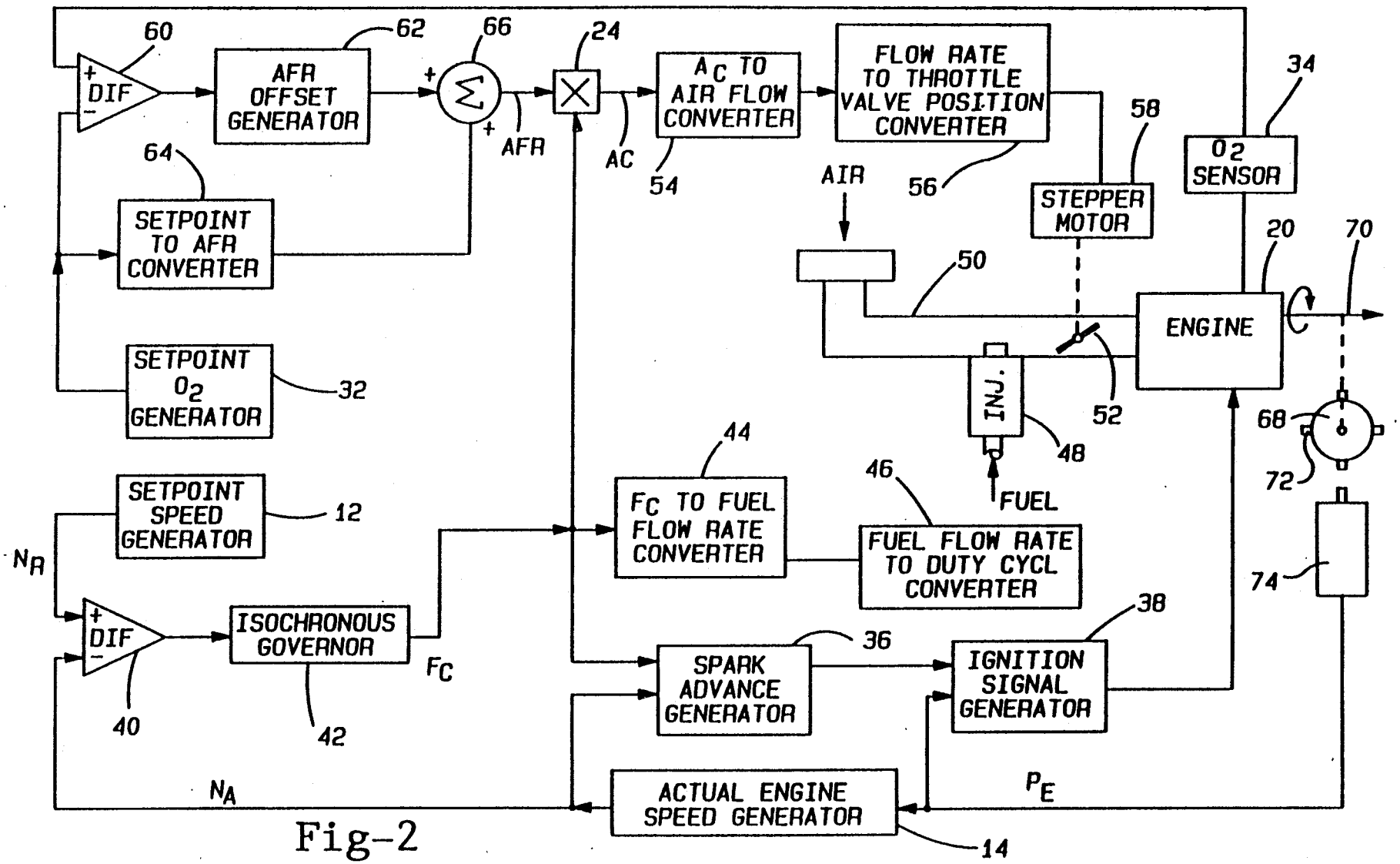
FIG. 2 is a more detailed block diagram of the pro-active engine control system for a rotary engine.

FIG. 2 is a block diagram of the pro-active engine control system showing in more detail a preferred embodiment. In this embodiment, the engine 20 is a rotary or Wankel type engine which drives a compressor (not shown) for an air conditioner or a heat pump. The fuel is either natural or propane gas. The Reference Engine Speed Governor 10 comprises a difference amplifier 40 and an Isochronous Governor 42. The difference amplifier 40 receives a setpoint or reference speed signal, $N_R$, indicative of a desired engine speed from the Set Point Speed Generator 12 and an actual speed signal, $N_A$, from the Actual Engine Speed Generator 14 and generates a difference signal corresponding to the difference between the setpoint speed signal and the actual speed signal. The Isochronous Governor 42, in response to the difference signal, generates the fuel command signal, $F_C$, which has a value corresponding to a fuel flow rate which will maintain the actual engine speed at the setpoint speed. The fuel command signal is received by an $F_C$ to Fuel Flow Rate Converter 44, which converts the fuel command signal $F_C$ to a fuel flow rate. The fuel flow rate is converted to pulse train signal having a duty cycle corresponding to the value of the fuel command signal. The pulse train signal actuates a fuel injector valve 48 to inject fuel into the air intake manifold 50 of the internal combustion engine 20 upstream of a throttle valve 52.

The fuel command signal, $F_C$, is also transmitted to a multiplier circuit 24 where it is multiplied with an air-fuel ratio signal, AFR, to generate the air command signal $A_C$. An $A_C$ to Air Flow Rate Convertor 54 converts the air command signal to an air flow rate signal which is transmitted to a Flow Rate to Throttle Valve Position Convertor 56. The Flow Rate to Throttle Valve Position Convertor 56 generates a signal activating the motor 58 to rotate the throttle valve 52, disposed in the engine's air intake manifold 50, to a position at which the air flow to the engine corresponds to the air flow rate signal, $A_C$. In this manner, the air-fuel ratio of the air-fuel mixture being supplied to the engine is maintained at the desired value.

The oxygen content of the exhaust of Engine 20 is measured by a fast acting proportional $O_2$ sensor 34 which outputs an $O_2$ signal having a value indicative of the actual $O_2$ content of the exhaust gases. The actual $O_2$ signal is received at a negative input of a difference amplifier 62. A setpoint $O_2$ signal generated by a Setpoint $O_2$ Generator 32 is received at the positive input of the difference amplifier 32. The difference amplifier generates an $O_2$ difference signal which is used by an AFR Offset Generator 62 to generate an air-fuel ratio offset signal. The setpoint $O_2$ signal is also received by a Setpoint to AFR Convertor 64 which generates a setpoint air-fuel ratio signal having a value corresponding to the value of the setpoint $O_2$ signal. The setpoint air-fuel ratio signal is summed with the offset $O_2$ signal in the sum amplifier 66 to generate the desired air-fuel ratio signal AFR received by the multiplier circuit 24. This procedure compensates for manufacturing tolerances and for wear in the fuel injector valve 48 and the throttle valve 52 which would otherwise result in an air-fuel ratio different from the setpoint air-fuel ratio. Effectively, the engine control loop is closed about the desired air-fuel ratio and adjusts the air flow rate to maintain the desired air-fuel ratio.

As indicated above, the engine 20 operates with a lean air-fuel ratio in which the $O_2$ content, or oxygen partial pressure of the exhaust gas, is maintained at approximately 4%. As is known in the art, a lean air-fuel ratio minimizes the emissions of carbon monoxide and hydrocarbons, effectively eliminating the need for a catalytic converter.

The engine position sensor 16 comprises a timing wheel 68 mechanically linked or attached to a rotary member of the engine 20, such as the rotary output or crankshaft 70. The timing wheel has a plurality of teeth 72 indexed to predetermined positions of the rotor of a rotary engine or the crankshaft of a piston engine. These predetermined positions may be equated to the top dead center position of each combustion chamber or a predetermined angle advanced from the top dead center position as is known in the art. As the timing wheel 68 rotates, the passing of each tooth 72 is detected by a magnetic pickup 74. The magnetic pickup contains a magnetic pole and when the magnetic field generated magnetic pole is disturbed by each of the teeth 72 passing adjacent thereto, the magnetic pickup 74 will generate a position pulse signal, $P_E$.

The Actual Engine Speed Generator 14, as previously described, will measure the time between the individual position pulse signals, $P_E$, and generate the actual engine speed signal, $N_A$. The actual engine speed, as is known in the art, is an inverse function of the time interval between successive position pulse signals. The actual engine speed signal, $N_A$, and the fuel command signal, $F_C$, are received by the Spark Advance Generator 38 which computes a spark advance signal indicative of an angle advanced from the top dead center position of each combustion chamber which will optimize the torque generated by the engine by the burning of the air-fuel mixture as conventionally done for internal combustion engines. This spark advance signal and the position pulse signal, $P_E$, are received by the Ignition Signal Generator 38 which energizes each spark plug in the engine at a time prior to the moving member (rotor or piston) of its associated combustion chamber reaching its top dead center position. The time prior to the moving member of the associated combustion chamber reaching its top dead center position is determined by the associated spark advance signal.

Having described the pro-active engine control system, it is recognized that those skilled in the art may make certain modifications and improvements to the engine control system shown on the drawings and described in the specification without deviating from the spirit of the invention as set forth in the appended claims.

What we claim is:

1. A pro-active engine control system comprising:

means responsive to a rotating member of said engine for generating an actual engine speed signal;

means responsive to the oxygen content of exhaust gases emitted by said engine for generating an actual oxygen content signal;

governor means responsive to said actual speed signal for generating a fuel command signal having a value operative to maintain the rotational speed of said engine at a setpoint speed;

a fuel delivery device for supplying fuel to said engine;

fuel logic means for actuating said fuel delivery device to deliver fuel to said engine at a rate determined to maintain the rotational speed of said engine at said setpoint speed in response to said actual engine speed signal;

an air delivery device for delivering air to said engine;

air fuel ratio generator means responsive to said actual oxygen content signal for generating a desired air-fuel ratio signal;

multiplier means for multiplying said desired air-fuel ratio signal by said fuel command signal to generate an air command signal; and air logic means for actuating said air delivery means to deliver air to said engine at a rate corresponding to said air command signal, said air flow rate and said fuel flow rate forming an air-fuel mixture having a ratio equal to said setpoint air-fuel ratio.

2. The pro-active engine control system of claim 1 wherein said governor means comprises:

means for generating a setpoint speed signal having a value corresponding to a desired speed of said engine;

a difference amplifier for generating a difference signal having a value corresponding to the difference between the value of said setpoint speed signal and said actual speed signal; and means responsive to said difference signal for generating said fuel command signal.

3. The pro-active engine control system of claim 1 wherein said means for generating an actual engine speed comprises:

an engine position sensor for producing engine position signals at predetermined rotational positions of a rotary member of said engine;

speed signal generator means responsive to frequency at which said engine position signals are produced for generating said actual engine signal.

4. The pro-active engine control system of claim 1 wherein said engine has at least one combustion chamber and a spark plug associated therewith, said pro-active engine control system further comprising:

spark advance means for generating a spark advance signal in response to said fuel command signal and said actual engine speed signal which will optimize the burning of said air and said fuel in said combustion chamber to produce a maximum torque; and ignition signal generator means for generating an ignition signal in response to said spark advance signal and said engine position signals to activate said spark plug to ignite said air-fuel mixture at a time to produce said maximum torque.

5. The pro-active engine control system of claim 1 wherein said fuel delivery device comprises a fuel injector, said fuel logic means comprises means for converting said fuel command signal to injector drive pulses at a predetermined frequency, each injector drive pulse having a pulse duration which is a function of the value of said fuel command signal, said injector drive pulses actuating said fuel injector to deliver fuel to said engine at a rate corresponding to the value of said fuel command signal.

6. The pro-active engine control system of claim 1 wherein said engine has an air intake manifold, said air delivery device comprises a throttle valve disposed in said air intake manifold to control the rate at which air is delivered to the engine and wherein said air logic means generates signals activating said motor to rotate said throttle valve to a position at which said air flow rate to the engine corresponds to the value of said air command signal.

7. The pro-active engine control system of claim 6 wherein said motor is a stepper motor, and wherein said air logic means generates a number of step pulses required by said stepper motor to rotate said throttle valve from its current position to said position at which said air flow rate to said engine corresponds to the value of said air command signal.

8. The pro-active engine control system of claim 1 wherein said engine is a rotary engine.

9. The pro-active engine control system of claim 1 wherein said engine is a piston engine having at least one combustion chamber.

10. The pro-active engine control system of claim 1 wherein said fuel is a gas.

11. The pro-active engine control system of claim 1 wherein said fuel is a liquid.

12. A control system for a heat engine having at least one combustion chamber, a spark plug associated with each of said at least one combustion chambers, an engine speed sensor for generating an actual speed signal, and an oxygen sensor for generating an actual $O_2$ signal having a value corresponding to the actual oxygen content of the engine's exhaust gas, said control system comprising:

means for generating a setpoint engine speed signal corresponding to a desired rotational speed of said engine;

governor means for generating a fuel command signal in response to said setpoint engine speed signal and said actual speed signal, said fuel command signal having a value corresponding to a fuel flow rate required to maintain said actual engine speed at said desired engine speed;

fuel delivery means for delivering fuel to said engine;

fuel logic means for actuating said fuel delivery means to deliver fuel to said engine at said fuel flow rate required to maintain said actual engine speed at said desired engine speed in response to said fuel command signal;

means for generating an oxygen setpoint signal indicative of said exhaust of said engine having a predetermined oxygen content;

means for generating a desired air-fuel ratio signal in response to said oxygen setpoint signal and said actual $O_2$ signal, said desired air-fuel ratio signal being indicative of a desired ratio of the air-to-fuel mixture being supplied to the engine;

air delivery means for controlling the rate at which air is delivered to said engine; and air logic means responsive to said desired air-fuel ratio signal and said fuel command signal for actuating said air delivery means to deliver air to said engine at a rate to form an air-fuel mixture having a ratio of air-to-fuel equal to said desired air-fuel ratio.

13. The control system of claim 12 wherein said engine speed sensor comprises:

engine position sensor means for generating engine position signals at predetermined rotational positions of a rotating member of said engine; and means for generating said actual engine speed signals in response to said engine position signals.

14. The control system of claim 13 wherein said engine position sensor comprises:

a timing wheel attached to said rotating member of said engine, said timing wheel having a plurality of teeth, each tooth of said plurality of teeth corresponding to predetermined positions of a moving member relative to each combustion chamber of said engine;

stationary magnetic pickup means disposed adjacent to said timing wheel for generating said engine position signals each time a tooth of said plurality of teeth passes thereby.

15. The control system of claim 13 further comprising:

advance signal generator means for generating a spark advance signal in response to said actual engine speed signal and said fuel command signal;

ignition signal generator means for energizing said spark plug associated with said at least one combustion chamber at a time determined to maximize the torque produced by said engine in response to engine position signals and said spark advance signals.

16. The control system of claim 13 wherein said governor means comprises:

a difference amplifier for generating an engine speed difference signal in response to said setpoint speed signal and said actual speed signal, said engine speed difference signal having a value corresponding to the difference between the value of said setpoint speed signal and the value of said actual speed signal; and means for generating said fuel command signal in response to said engine speed difference signal.

17. The control system of claim 16 wherein said fuel delivery device is a solenoid actuated fuel injector, said fuel logic means includes means for converting said fuel command signal to injector drive pulses at a predetermined frequency, each injector drive pulse having a pulse width which is a function of the value of said fuel command signal, said injector drive pulses actuating said solenoid actuated fuel injector to deliver fuel to said engine at said fuel flow rate required to maintain said actual engine speed equal to said setpoint engine speed.

18. The control system of claim 17 wherein said fuel injector delivers a gaseous fuel to said engine.

19. The control system of claim 17 wherein said fuel injector delivers a liquid fuel to said engine.

20. The control system of claim 16 wherein said engine has an air intake manifold, said air delivery means comprises:

a throttle valve rotatably disposed in said intake manifold to control the air flow rate to said engine; and a motor for rotating said throttle valve in response to signals generated by air logic means.

21. The control system of claim 20 wherein said motor is a stepper motor, said air logic means includes means for generating pulse signals activating said stepper motor to step the output of said stepper motor from its current position to a new position rotating said throttle valve to a position in which said air flow rate to said engine produces an air-fuel mixture having an air-to-fuel ratio equal to said desired air-fuel ratio.

22. The control system of claim 21 wherein said engine is a rotary engine.

23. A method for controlling a heat engine comprising the steps of:

detecting the rotary speed of a rotary member of said engine to generate an actual engine speed signal;

measuring the oxygen content of the exhaust gas generated by said heat engine to generate an actual $O_2$ content signal;

generating a fuel command signal having a value determined to maintain the rotational speed of said heat engine at a desired speed in response to said actual speed signal;

delivering fuel to said engine at a rate required to maintain said actual speed of said heat engine equal to said desired speed in response to said fuel command signal;

generating a desired air-fuel ratio signal in response to actual $O_2$ content signal;

multiplying said desired air-fuel ratio signal with said fuel command signal to generate an air command signal;

delivering air to said heat engine in response to said air command signal at a rate which when mixed with said fuel delivered to said heat engine produces an air-fuel mixture having a ratio of air-to-fuel equal to said desired air-fuel ratio.

24. The method of claim 23 wherein said step of generating an actual engine speed signal comprises the steps of:

detecting predetermined rotational positions of said rotary member to generate rotational position signals; measuring the time interval between said rotational position signals to generate said actual engine speed signal.

25. The method of claim 24 wherein said step of generating a fuel command signal comprises the steps of:

generating a setpoint speed signal having a value corresponding to a desired speed of said engine;

generating a difference signal having a value corresponding to the difference between the value of said setpoint speed signal and said actual speed signal; and generating said fuel command signal in response to said difference signal.

26. The method of claim 25 wherein said engine has at least one combustion chamber and a spark plug associated therewith, said method further comprises the steps of:

generating a spark advance signal in response to said fuel command signal and said actual engine speed signal;

generating an ignition signal in response to said spark advance signal and said engine position signals to activate said spark plug to ignite said air-fuel mixture at a time to produce said maximum torque.

27. The method of claim 26 wherein said fuel delivery device comprises a fuel injector, said step of generating a fuel command signal includes the step of converting said fuel command signal to injector drive pulses at a predetermined frequency, each injector drive pulse having a pulse duration which is a function of the value of said fuel command signal, said injector drive pulses actuating said fuel injector to deliver fuel to said engine at a rate corresponding to the value of said fuel command signal.

28. The method of claim 27 wherein said engine has an air intake manifold, said air delivery device comprises a throttle valve disposed in said air intake manifold to control the rate at which air is delivered to the engine and wherein said step of delivering air comprises the step of generating signals activating said motor to rotate said throttle valve to a position at which said air flow rate to the engine corresponds to the value of said air command signal.

29. The method of claim 28 wherein said motor is a stepper motor, and wherein said step of generating signals activating said motor comprises the step of generating a number of step pulses required by said stepper motor to rotate said throttle valve from its current position to said position at which said air flow rate to said engine corresponds to the value of said air command signal.

30. The method of claim 23 wherein said engine is a rotary engine.

31. The method of claim 23 wherein said engine is a piston engine having at least one combustion chamber.

32. The method of claim 23 wherein said fuel is a gas.

33. The method of claim 23 wherein said fuel is a liquid.

* * * * *